US009207016B2

(12) United States Patent
Park et al.

(10) Patent No.: US 9,207,016 B2
(45) Date of Patent: Dec. 8, 2015

(54) LAUNDRY TREATING APPARATUS

(71) Applicant: LG ELECTRONICS INC., Seoul (KR)

(72) Inventors: Deayun Park, Seoul (KR); Taehyun Kim, Seoul (KR); Woohee Kang, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 52 days.

(21) Appl. No.: 14/029,329

(22) Filed: Sep. 17, 2013

(65) Prior Publication Data

US 2014/0082955 A1 Mar. 27, 2014

(30) Foreign Application Priority Data

Sep. 21, 2012 (KR) ..... 10-2012-0105359

(51) Int. Cl.

*D06F 58/20* (2006.01)
*F26B 25/16* (2006.01)
*D06F 58/04* (2006.01)

(52) U.S. Cl.

CPC ..... *F26B 25/16* (2013.01); *D06F 58/04* (2013.01)

(58) Field of Classification Search

CPC ..... F26B 19/00; F26B 21/00; F26B 21/06; F26B 21/10; D06F 58/20; D06F 58/00
USPC ..... 34/82, 601, 606, 610; 68/19, 20; 8/149, 8/159
See application file for complete search history.

(56) References Cited

U.S. PATENT DOCUMENTS

| | | | | |
|---|---|---|---|---|
| 2,752,694 | A * | 7/1956 | McCormick | 34/60 |
| 3,995,988 | A * | 12/1976 | Freze | 432/21 |
| 4,065,253 | A * | 12/1977 | Bullock | 432/105 |
| 4,137,645 | A * | 2/1979 | Bullock | 34/467 |
| 4,154,003 | A * | 5/1979 | Muller | 34/469 |
| 4,811,495 | A * | 3/1989 | Huang et al. | 34/131 |
| 7,036,243 | B2 * | 5/2006 | Doh et al. | 34/595 |
| 7,228,647 | B2 * | 6/2007 | Hong | 34/596 |
| 7,627,960 | B2 * | 12/2009 | Beyerle et al. | 34/602 |
| 7,765,716 | B2 * | 8/2010 | Kim | 34/602 |
| 7,946,054 | B2 * | 5/2011 | Dittmer et al. | 34/63 |
| 7,992,322 | B2 * | 8/2011 | Kim | 34/595 |
| 8,015,726 | B2 * | 9/2011 | Carow et al. | 34/381 |
| 8,112,903 | B2 * | 2/2012 | Favret et al. | 34/595 |
| 8,156,660 | B2 * | 4/2012 | Carow | 34/485 |
| 8,434,243 | B2 * | 5/2013 | Kim et al. | 34/606 |
| 2005/0223585 | A1 * | 10/2005 | Jeon et al. | 34/82 |
| 2014/0082955 | A1 * | 3/2014 | Park et al. | 34/82 |
| 2014/0182159 | A1 * | 7/2014 | Shin et al. | 34/130 |

FOREIGN PATENT DOCUMENTS

| | | | |
|---|---|---|---|
| CN | 1696387 | A | 11/2005 |
| DE | 1610236 | B1 | 9/1972 |
| EP | 1403416 | A1 | 3/2004 |
| EP | 1600548 | A2 | 11/2005 |
| KR | 1020030012265 | A | 2/2003 |

* cited by examiner

*Primary Examiner* — Stephen M Gravini
(74) *Attorney, Agent, or Firm* — Dentons US LLP

(57) ABSTRACT

Disclosed is an apparatus for treating laundry for making a laundry treating capacity the largest.

The disclosed laundry treating apparatus includes a cabinet, a drum rotatably provided in the cabinet to hold laundry, the drum including a drum front portion, a drum center portion, and a drum rear portion, wherein the front portion includes a plurality of discharge holes, and wherein the rear portion includes a plurality of suction holes, a front supporter to support the front portion of the drum and to surround the plurality of the discharge holes, and a rear supporter to support the rear portion of the drum and to surround the plurality of the suction holes.

13 Claims, 4 Drawing Sheets

LAUNDRY TREATING APPARATUS

CROSS-REFERENCE TO RELATED APPLICATION

This application claims priority to and benefit of the Korean Patent Application No. 10-2012-0105359 filed in the Korean Intellectual Property Office on Sep. 21, 2012, the entire contents of which are incorporated herein by reference.

BACKGROUND OF THE INVENTION

1. Field of the Invention

An exemplary embodiment of the present invention relates to an apparatus for treating laundry.

More particularly, the present invention relates to an apparatus for treating laundry for making a laundry treating capacity the largest.

2. Description of the Related Art

The laundry treating apparatus means all kinds of apparatuses for managing or treating clothes, beddings and so on, such as washing, drying, crumple removal, and the like. In the laundry treating apparatus, there are a washing machine for separating dirt from the laundry using chemical decomposition by water and detergent, and physical action, such as friction, between the water and the laundry, a dryer for extracting water from wet laundry to dry the laundry, and a refresher for spraying heated steam to the laundry, to prevent allergy from causing by the laundry, as well as washing the laundry, conveniently.

In general, the dryer is a domestic appliance for drying washed laundry by using heated air. In general, the dryer has a drum which is rotated with the laundry held therein. Heated dry air is supplied to the drum which is rotating with the laundry held therein, and wet air is discharged from an inside of the drum. The dryer is required to secure a largest holding space of the drum for treating a large amount of the laundry at a time.

SUMMARY OF THE INVENTION

An object of an exemplary embodiment of the present invention is to provide a laundry treating apparatus which can make a holding space of a drum a largest.

Another object of exemplary embodiment of the present invention is to provide a laundry treating apparatus for making a laundry treating capacity a largest to provide a laundry treating apparatus which is convenient to use.

Objects of the present invention are not limited to the objects set forth herein, and other objects not mentioned herein may be understood clearly to persons skilled in this field of art from description given below.

To achieve these objects and other advantages, a laundry treating apparatus includes, a cabinet, a drum rotatably provided in the cabinet to hold laundry, the drum including a drum front portion, a drum center portion, and a drum rear portion, wherein the front portion includes a plurality of discharge holes, and wherein the rear portion includes a plurality of suction holes, a front supporter to support the front portion of the drum and to surround the plurality of the discharge holes, and a rear supporter to support the rear portion of the drum and to surround the plurality of the suction holes.

To achieve these objects and other advantages, a laundry treating apparatus includes, a cabinet, a drum rotatably provided in the cabinet to hold laundry, the drum having a plurality of discharge holes formed in a portion of a front circumferential surface thereof, and a front supporter to support a front end of the drum and to surround the plurality of the discharge holes, the front supporter having an introduction hole formed therein to access the inside of the drum.

Details of other embodiments are described in the detailed description of the embodiments and drawings.

BRIEF DESCRIPTION OF THE DRAWINGS

The attached drawings illustrate exemplary embodiments of the present invention, provided for describing the present invention in more detail, but not for limiting technical aspects of the present invention.

DETAILED DESCRIPTION OF THE EMBODIMENTS

Advantages, features and methods for achieving same will become apparent upon referring to embodiments which will be described in detail later together with the attached drawings. However, the present invention is, not limited to the embodiments disclosed hereafter, but can be embodied in different modes. The embodiments are provided to make scope of the present invention known to those skilled in this field of art completely, and the present invention is defined only by scopes of claims of the present invention. Throughout the specification, same reference number refers to same element.

The present invention will be described with reference to the drawings provided for describing a laundry treating apparatus in accordance with exemplary embodiments of the present invention.

Figure 1:
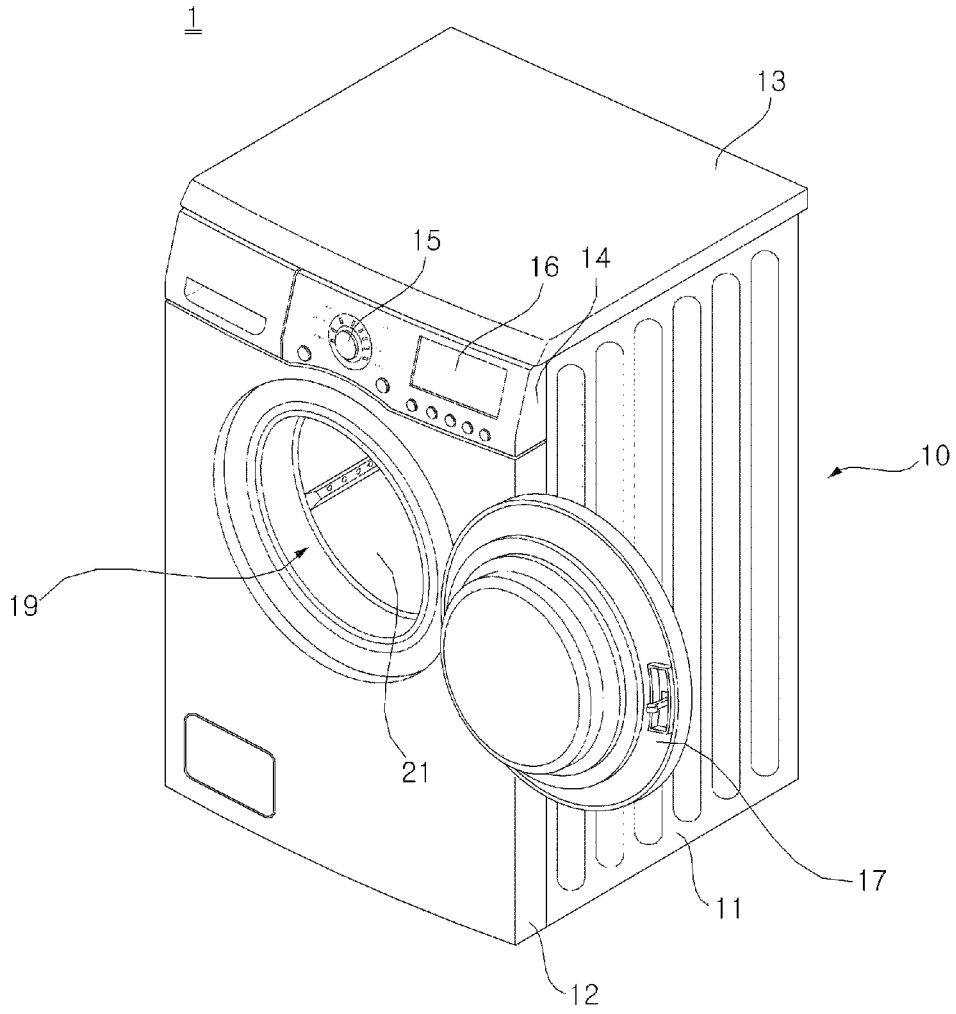
FIG. 1 illustrates a perspective view of a laundry treating apparatus in accordance with an exemplary embodiment of the present invention.
Figure 2:
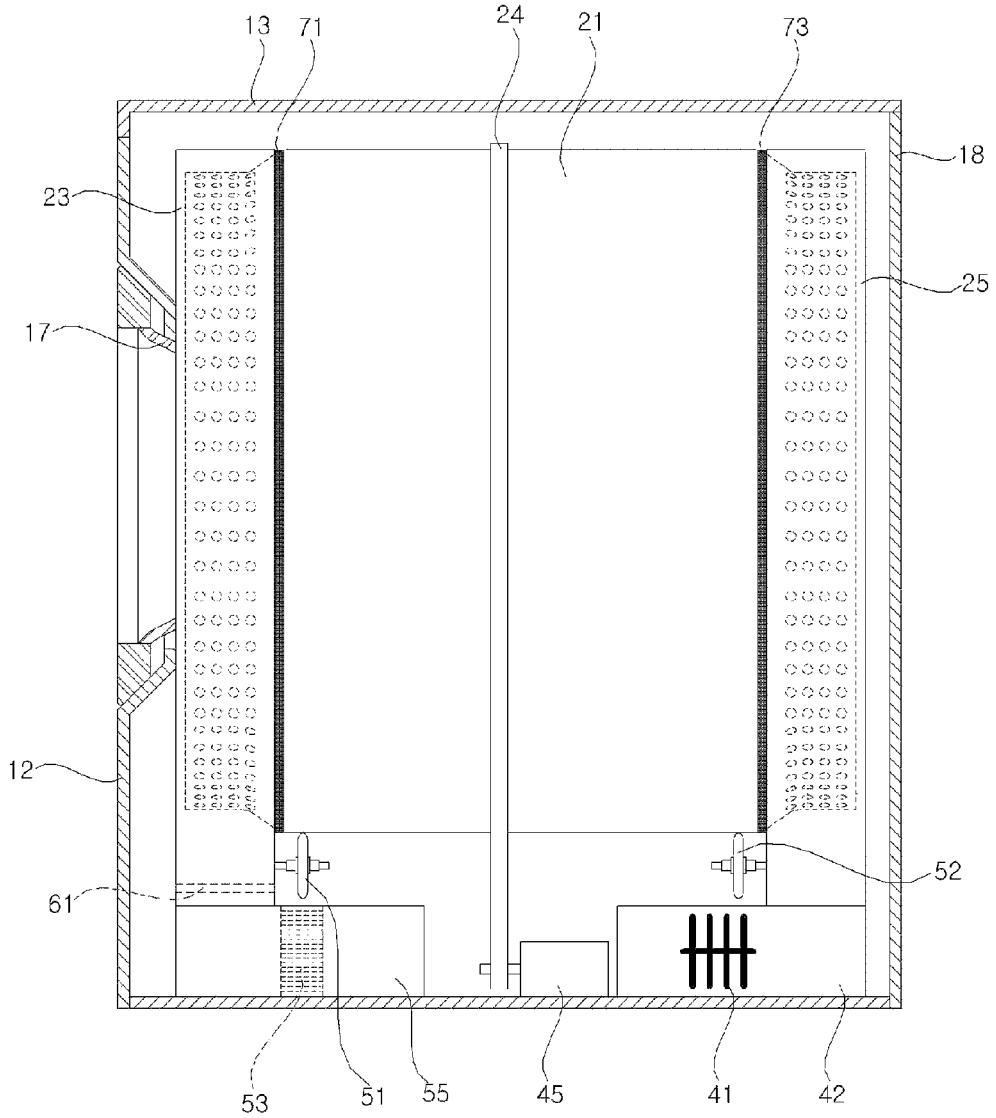
FIG. 2 illustrates a longitudinal section of the laundry treating apparatus in FIG. 1.

FIG. 1 illustrates a perspective view of a laundry treating apparatus in accordance with an exemplary embodiment of the present invention, and FIG. 2 illustrates a longitudinal section of the laundry treating apparatus in FIG. 1.

Referring to FIGS. 1 and 2, the laundry treating apparatus 1 includes a cabinet 10, and a drum 21 rotatably mounted in the cabinet 10 for holding laundry, such as clothes.

The cabinet 20 which forms an exterior appearance of the laundry treating apparatus 1 includes a cabinet body 11, a front cover 12 coupled to a front of the cabinet body 11 having an introduction hole 19 in a center portion thereof for allowing in/out of the laundry, a back panel 18 coupled to a rear of the cabinet body 11, a control panel 14 provided to a top side of the front cover, and a top cover 13 coupled to a top side of the cabinet body 11. Depending on embodiments, the cabinet body 11 and the back panel 18 may be formed as one unit by bending one panel.

The front cover 12 has a door 17 rotatably provided thereto for opening/closing the introduction hole 19, and the control panel 14 is provided with an input unit 15 for having different control orders on operation of the laundry treating apparatus applied thereto, and a display unit 16 for displaying different pieces of information on an operation state of the laundry treating apparatus.

The drum 21 has a cylindrical shape with opened front and rear. The drum 21 is arranged in the cabinet 10. The drum 21 is rotatably supported by a front supporter 23 and a rear supporter 25.

The drum 21 is rotated by a belt 24 which surrounds a circumference of the drum 21. A motor 45 provides rotating force for rotating the belt 24. The motor 45 may rotate, not only the belt 24, but also a fan 53, altogether.

The front supporter 23 supports a front end of the drum 21, rotatably. The front supporter 23, arranged in rear of the front cover 12, covers the front of the drum 21 which is opened, and surrounds a portion of a front end of a circumferential surface of the drum 21.

There is a ring shaped front sealer 71 arranged between the drum 21 and the front supporter 23. The front sealer 71 provides a seal between the drum 21 and the front supporter 23 enabling the drum 21 to rotate, smoothly. The front sealer 71 may be formed of a synthetic material having polytetrafluoroethylene (PTFE) oil percolated therein, fabric, or rubber.

The front supporter 23 has a front roller 51 provided thereto. The front roller 51 supports the drum 21 to be able to rotate, smoothly.

The front supporter 23 has discharge air flowing therethrough from an inside of the drum 21. The front supporter 23 has a filter 61 for filtering the air being discharged from the inside of the drum 21. The filter 61 is detachably arranged at a lower side of the front supporter 23.

The front supporter 23 is connected to an air discharge duct 55. The air discharge duct 55 has the air being discharged to the front supporter 23 flowing therethrough from the inside of the drum 21. The fan 53 is arranged in the discharge duct 55 for blowing the air. The fan 53 makes the air to move to an inside of the cabinet 10 from the inside of the air discharge duct 55. Depending on embodiments, the air discharge duct 55 may be connected to an outside of the cabinet 10 for making the air to flow to the outside of the cabinet 10 from the inside of the air discharge duct 55, or the air discharge duct 55 may be connected to an air suction duct 42 such that the air flows to the air suction duct 42 from the inside of the air discharge duct 55.

The rear supporter 25 rotatably supports a rear end of the drum 21. The rear supporter 25 is arranged in front of the back panel 18 for covering the opened rear of the drum 21 to surround a portion of a circumferential surface of the rear of the drum 21.

There is a ring shaped rear sealer 73 arranged between the drum 21 and the rear supporter 25. The rear sealer 73 provides a seal between the drum 21 and the rear supporter 25 for enabling the drum 21 to rotate, smoothly. The rear sealer 73 may be formed of a synthetic material having polytetrafluoroethylene (PTFE) oil percolated therein, fabric, or rubber.

The rear supporter 25 has a rear roller 52 provided thereto. The rear roller 52 supports the drum 21 to be able to rotate, smoothly.

The rear supporter 25 has air being supplied to the inside of the drum 21 flowing therethrough. The rear supporter 25 has the air suction duct 42 connected thereto. The air suction duct 42 heats the air being supplied to the inside of the drum 21 through the rear supporter 25. There is a heater 41 in the air suction duct 42 for heating the air. The air flows from the inside of the cabinet to the air suction duct 42. Depending on embodiments, the air suction duct 42 may be connected to the outside of the cabinet 10 for introducing the air from the outside of the cabinet 10 to the inside of the air suction duct 42, or the air suction duct 42 may be connected to the air discharge duct 55 for introducing the air being discharged to the air discharge duct 55 to the air suction duct 42.

Figure 3:
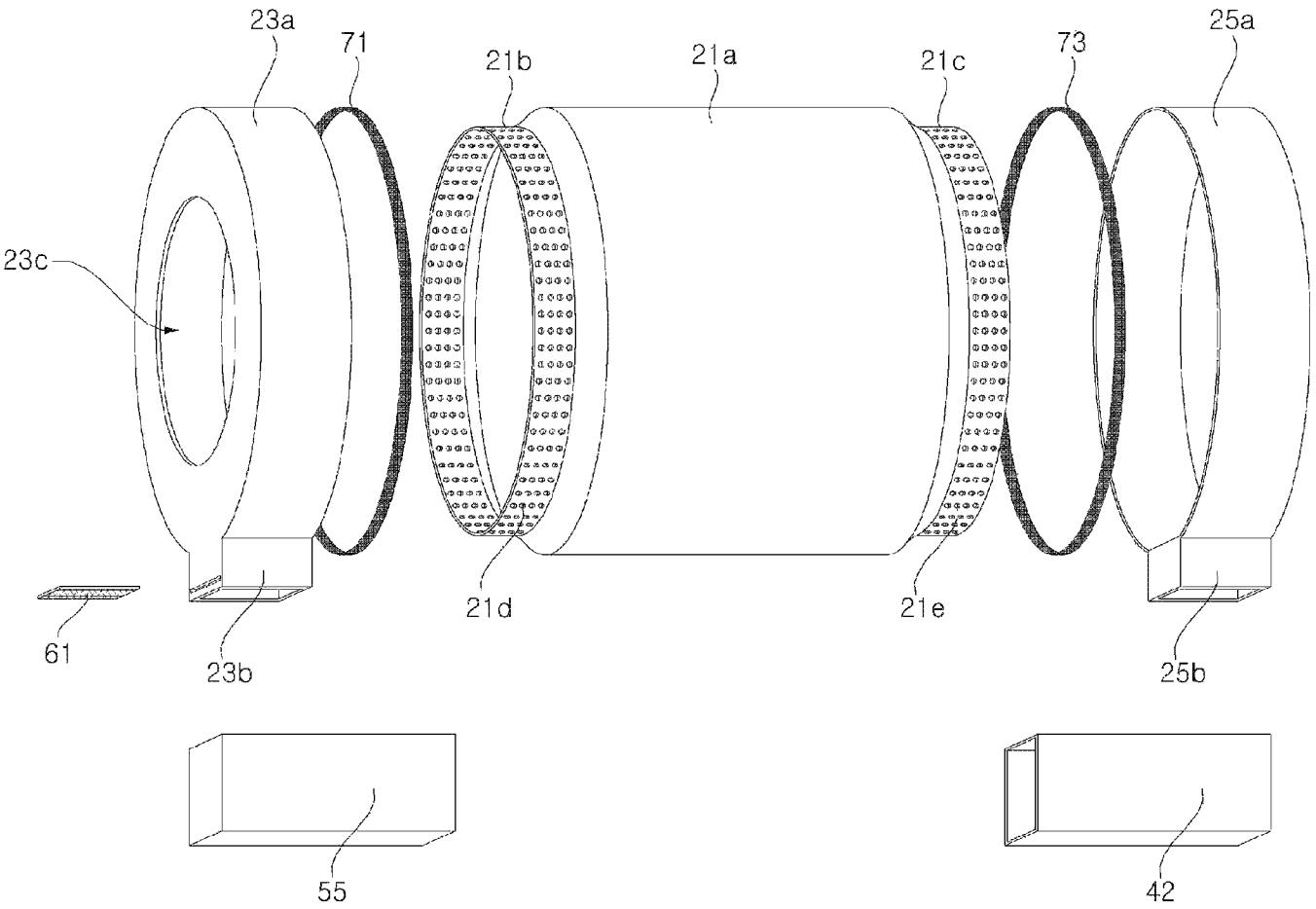
FIG. 3 illustrates a partial exploded perspective view of the laundry treating apparatus in FIG. 1.

FIG. 3 illustrates a partial exploded perspective view of the laundry treating apparatus in FIG. 1.

The drum 21 includes a drum center portion 21*a* which forms a center portion of a circumferential surface of the drum 21, a drum front portion 21*b* which forms a front portion of the circumferential surface of the drum 21, and a drum rear portion 21*c* which forms a rear portion of the circumferential surface of the drum 21.

The drum center portion 21*a* is a center portion of the drum 21 having a cylindrical shape with opened both ends. It is preferable that the drum center portion 21*a* has a cylindrical shape with a fixed diameter. The drum center portion 21*a* holds the laundry. The belt 24 looped over the circumference of the drum center portion 21*a*. The drum center portion 21*a* is in contact with the front roller 51 and the rear roller 52. The drum center portion 21*a* has a front connected to the drum front portion 21*b*, and a rear connected to the drum rear portion 21*c*.

The drum front portion 21*b* couples to a front of the drum center portion 21*a*. The drum front portion 21*b* is a front circumferential surface of the drum 21, and has a plurality of discharge holes 21*d* formed therein for discharging the air from the inside of the drum 21. It is preferable that the drum front portion 21*b* has a diameter smaller than a diameter of the drum center portion 21*a*. The drum front portion 21*b* is surrounded by the front supporter 23. It is preferable that a front sealer 71 is arranged at a boundary of the drum front portion 21*b* and the drum center portion 21*a*.

The drum rear portion 21*c* couples to a rear of the drum center portion 21*a*. The drum rear portion 21*c* is a rear circumferential surface of the drum 21, and has a plurality of suction holes 21*e* formed therein for passing the air to the inside of the drum 21. It is preferable that the drum rear portion 21*c* has a diameter smaller than a diameter of the drum center portion 21*a*. The drum rear portion 21*c* is surrounded by the rear supporter 25. There is a rear sealer 73 arranged at a boundary of the drum rear portion 21*c* and the drum center portion 21*a*.

Depending on embodiments, the drum front portion 21*b*, the drum center portion 21*a*, and the drum rear portion 21*c* may be formed as one unit, or connected to each other by welding.

The front supporter 23 includes a front cover portion 23*a* which surrounds the drum front portion 21*b*, and a front connection portion 23*b* for connecting a lower side of the front cover portion 23*a* to the air discharge duct 55.

The front cover portion 23*a* of a circular cap shape surrounds the circumferential surface and a front of the drum front portion 21*b*. The front cover portion 23*a* surrounds the plurality of discharge holes 21*d*, for the air being discharged through the plurality of discharge holes 21*d* flows. It is preferable that the front cover portion 23*a* has a front in close contact with an end of the front of the drum front portion 21*b*, and an end of a rear in close contact with the front sealer 71. It is preferable that the front cover portion 23*a* has a diameter larger than a diameter of the drum front portion 21*b*, and smaller than or the same as a diameter of the drum center portion 21*a*.

The front cover portion 23*a* has a front hole 23*c* formed therein to access the inside of the drum 21. The front hole 23*c* is formed matched to the introduction hole 19 in the front cover 12, and opened/closed by the door 17.

The front connection portion 23*b* is connected to an underside of the front cover portion 23*a* for discharging the air flowing through the front cover portion 23*a* to the air discharge duct 55 through the front connection portion 23*b*. The front connection portion 23*b* has a filter 61 detachably provided thereto. The filter 61 has a face arranged perpendicular to an air flow direction. It is preferable that the filter 61 is drawable in a front direction of the front connection portion 23*b*.

The rear supporter 25 includes a rear cover portion 25*a* which surrounds the drum rear portion 21*c*, and a rear connection portion 25*b* which connects a lower side of the rear cover portion 25*a* to the air suction duct 42.

The rear cover portion 25*a* has a shape of a cylindrical cap to surround a circumferential surface and a rear of the drum rear portion 21*c*. The rear cover portion 25*a* surrounds a plurality of suction holes 21*e*, and has the air being supplied to the plurality of suction holes 21*e* flowing therethrough. It is preferable that the rear cover portion 25*a* has a rear in close contact with an end of the rear of the drum rear portion 21*c*, and a front end in close contact with the rear sealer 73. It is preferable that the rear cover portion 25*a* has a diameter larger than a diameter of the drum rear portion 21*c*, and smaller than or the same as a diameter of the drum center portion 21*a*.

The rear connection portion 25*b* is connected to an underside of the rear cover portion 25*a* such that the air being supplied from the air suction duct 42 to flow to the rear cover portion 25*a* through the rear connection portion 25*b*.

Figure 4:
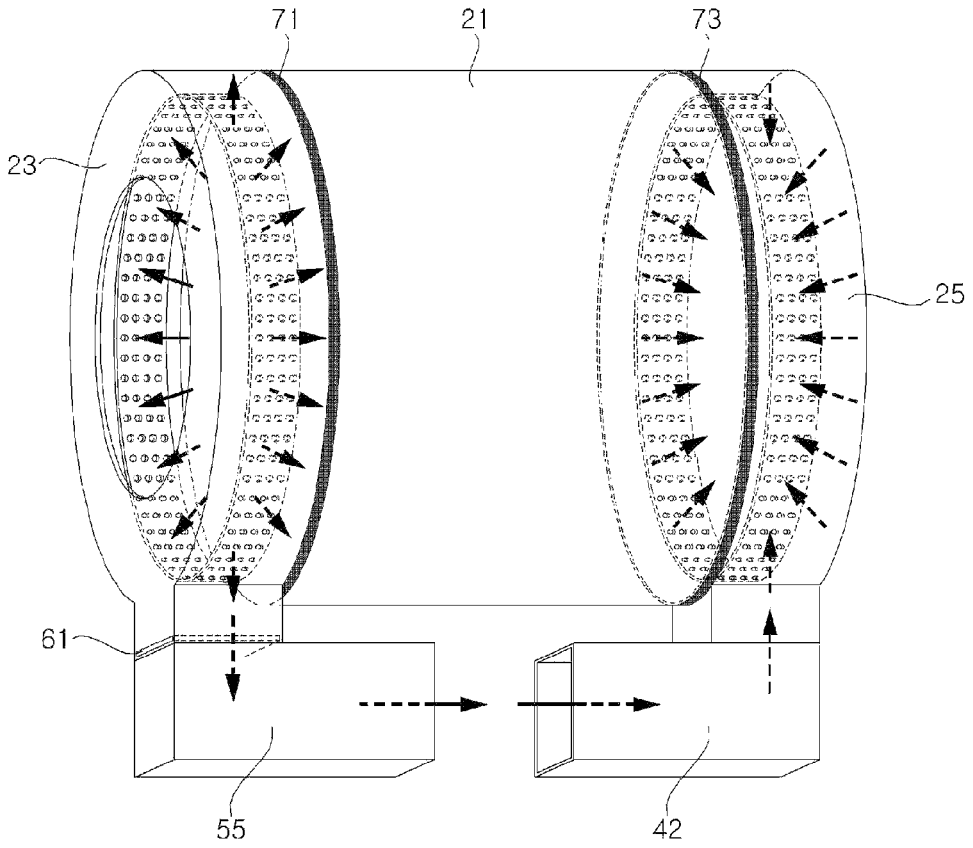
FIG. 4 illustrates a schematic perspective view of the laundry treating apparatus in FIG. 1 showing operation thereof.

FIG. 4 illustrates a schematic perspective view of the laundry treating apparatus in FIG. 1 showing operation thereof.

Referring to FIG. 4, the operation of the laundry treating apparatus of the present invention will be described.

A user opens the door 17, and introduces the laundry to the inside of the drum 21 through the introduction hole 19 and the front hole 23*c*. The user closes the door 17, and starts drying by handling the input unit 15.

If the drying is started, the motor 45 is driven to move the belt 24, and the belt 24 rotates the drum 21. If the fan 53 rotated by the motor 45 or other driving unit, the air is discharged from the inside of the drum 21 through the plurality of discharge holes 21*d* in the drum front portion 21*b*, radially. The air being discharged in a centrifugal direction through the plurality of discharge holes 21*d* flows between the drum front portion 21*b* and the front cover portion 23*a*, and, therefrom, is guided to the front connection portion 23*b*. The air passing through the front connection portion 23*b* is filtered by the filter 61, and flows to the inside of the cabinet 10 through the air discharge duct 55. The air discharge duct 55 guides the air discharged from an inside of the drum 21 through the plurality of discharge holes 21*d* and the front supporter 23.

If the air flows to the air discharge duct 55 from the drum 21 by the fan 53, dropping a pressure in the drum 21, the air flows into the air suction duct 42. The air suction duct 42 guides the air being supplied to the inside of the drum 21 through the plurality of suction holes 21*e*.

The air introduced to the air suction duct 42 is heated by the heater 41. The air heated by the heater 41 thus flows to the rear cover portion 25*a* through the rear connection portion 25*b* of the rear supporter 25. The air introduced between the rear cover portion 25*a* and the drum rear portion 21*c* is supplied to the inside of the drum 21 through the suction holes 21*e* in a radial direction.

The heated dry air introduced to the inside of the drum 21 through the plurality of suction holes 21*e* in the radial direction dries the laundry held in the drum 21.

As has been described, the laundry treating apparatus of the present invention has one or more of the following advantages.

First, the improvement in the air suction structure to the inside of the drum and the air discharge structure from the inside of the drum permits to have an advantage of making the drum capacity the largest.

Second, the formation of the air suction holes in the circumferential surface of the drum permits to have an advantage of supplying the air to the inside of the drum, uniformly.

Third, the formation of the air discharge holes in the circumferential surface of the drum permits to have an advantage of discharging the air from the inside of the drum, uniformly.

Fourth, the arrangement of the filter at the lower side of the front supporter which supports the drum front portion permits to have an advantage of making the hole formed in the front supporter for in/out of the laundry to be the largest.

Advantages of the present invention will not be limited by the advantages described herein, and other advantage not described herein will become apparent to those skilled in this field of art from appended claims.

What is claimed is:

1. A laundry treating apparatus comprising:

a cabinet;

a drum having a cylindrical shape with opened front and rear and rotatably provided in the cabinet to hold laundry, the drum having a plurality of discharge holes formed in a front portion of a circumferential surface thereof and a plurality of suction holes formed in a rear portion of the circumferential surface thereof;

a front supporter to cover the opened front and the front portion of the drum so to surround the plurality of the discharge holes; and a rear supporter to cover the opened rear and the rear portion of the drum so to surround the plurality of the suction holes.

2. The laundry treating apparatus of claim 1, further comprising:

an air discharge duct connected to the front supporter to guide the air discharged from an inside of the drum through the plurality of discharge holes and the front supporter.

3. The laundry treating apparatus of claim 2, further comprising:

a fan mounted in the air discharge duct to move the air.

4. The laundry treating apparatus of claim 1, further comprising:

a filter detachably arranged to the front supporter to filter the air discharged from the inside of the drum through the plurality of discharge holes.

5. The laundry treating apparatus of 1, further comprising:

an air suction duct connected to the rear supporter to guide the air being supplied to the inside of the drum through the plurality of suction holes.

6. The laundry treating apparatus of claim 5, further comprising:

a heater provided in the air suction duct to heat the air.

7. The laundry treating apparatus of claim 1, further comprising:

a ring shaped front sealer located between the drum and the front supporter to provide a seal therebetween.

8. The laundry treating apparatus of claim 1, further comprising:

a ring shaped rear sealer located between the drum and the rear supporter to provide a seal therebetween.

9. The laundry treating apparatus of claim 1, wherein the front portion of the drum has a diameter smaller than a diameter of a center portion of the circumferential surface of the drum, and the rear portion of the drum has a diameter smaller than the diameter of the center portion of the drum.

10. The laundry treating apparatus of claim 1, further comprising:

a belt looped over a center portion of the circumferential surface of the drum; and a motor to provide a rotation force to move the belt.

11. The laundry treating apparatus of claim 1, wherein the front supporter includes a front cover portion having a circular cap shape to cover the opened front and the front portion of the drum, and wherein the front cover portion has a diameter larger than the diameter of the front portion of the drum and smaller than or the same as a diameter of a center portion of the circumferential surface of the drum.

12. The laundry treating apparatus of claim 11, wherein the front cover portion has a front hole formed therein to access the inside of the drum.

13. The laundry treating apparatus of claim 1, wherein the rear supporter includes a rear cover portion having a circular cap shape to cover the opened rear and the rear portion of the drum, and wherein the rear cover portion has a diameter larger than the diameter of the rear portion of the drum and smaller than or the same as a diameter of a center portion of the circumferential surface of the drum.

* * * * *